United States Patent [19]

Brunner et al.

[11] Patent Number: 4,511,411

[45] Date of Patent: Apr. 16, 1985

[54] METHOD OF FORMING A HARD SURFACE LAYER ON A METAL COMPONENT

[75] Inventors: Paul Brunner, Münchenbuchsee; Beat Hofer, Derendingen, both of Switzerland

[73] Assignee: Vereinigte Drahtwerke AG, Biel, Switzerland

[21] Appl. No.: 528,954

[22] Filed: Sep. 2, 1983

[30] Foreign Application Priority Data

Sep. 7, 1982 [CH] Switzerland ..... 5313/82

[51] Int. Cl.[3] ..... B22F 3/24

[52] U.S. Cl. ..... 148/20.3; 148/16.6; 148/131

[58] Field of Search ..... 148/20.3, 16.6, 131

[56] References Cited

U.S. PATENT DOCUMENTS 1,793,309 2/1931 Egan ..... 148/16.6

FOREIGN PATENT DOCUMENTS 1573891 8/1980 United Kingdom .

OTHER PUBLICATIONS

Horn, G. & Saur, E., "Präparation und Supraleitungseigenschaften von Niobnitrid sowie Niobnitrid mit Titan-, Zirkon-, und Tantalzusatz", in *Zeitschrift für Physik,* vol. 210, No. 1, (1968), pp. 70–79.

*Primary Examiner*—Veronica O'Keefe
*Attorney, Agent, or Firm*—Holman & Stern

[57] ABSTRACT

A component of titanium or alloys thereof is placed in an autoclave. Nitrogen gas or ammonia is pumped into the autoclave. The chemically untreated component is exposed in the autoclave for three hours to a pressure of 900 bar and a temperature of 1000° C. The TiN layer thus formed in the surface- and subsurface-zone of the component has a Vickers hardness of 800 $_{0.05\ g/sq.mm.}$ with a thickness of 20 microns. With this economical method, an increase in surface hardness from Vickers hardness $_{0.05}$=450 with prior art methods to Vickers hardness $_{0.05}$=800 is achieved.

3 Claims, 2 Drawing Figures

METHOD OF FORMING A HARD SURFACE LAYER ON A METAL COMPONENT

Figure 1:
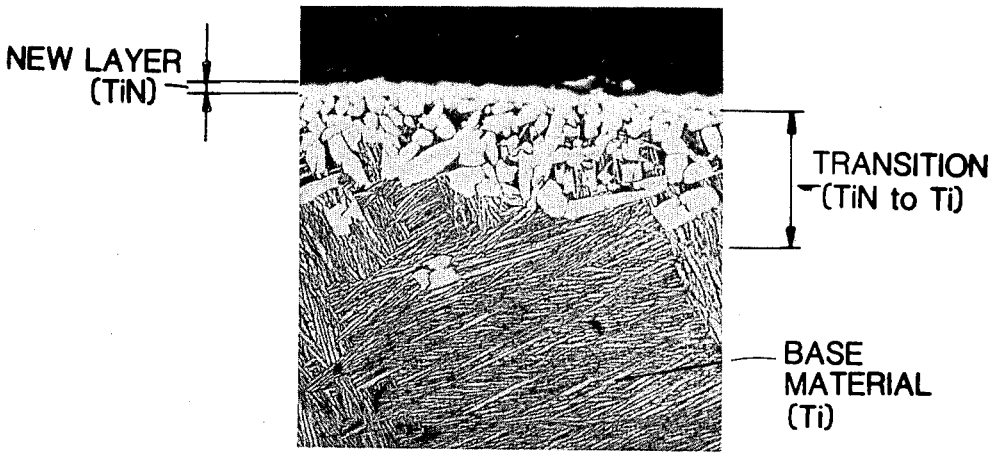

This invention relates to nitriding methods, and particularly to a method of forming a nitride layer in the surface- and subsurface-zone of a component made of elements of the fourth, fifth, or sixth subgroups of the periodic table or alloys thereof.

The nitride layer is intended to increase the wear-resistance of the surface of, e.g., titanium or alloys thereof. Examples of components made of surface-hardened titanium are turbine blades, thread guides on textile machines, the ball portions of ball-and-socket prostheses, and wear- and corrosion-resistant parts of apparatuses used in the chemical industry.

Surface oxidation of titanium components by heating is known in the art. Oxygen from the air combines with the titanium to form a thin layer of $TiO_2$. It is not possible to make the oxide layer deeper because otherwise the oxygen attack leads to deterioration of the titanium component.

Another possibility of hardening the surface of a titanium component is to immerse it in a cyanide-base salt melt at a temperature of about 800° C. This treatment produces a mixed-crystal zone containing nitrogen, carbon, and a small proportion of oxygen. The thickness of the layer is about 0.035 mm for a Vickers hardness of $700_{0.025\ g/sq.mm.}$ on the outside zone. This is the well-known "Tiduran" process of Degussa AG, Rodenbacherchaussee 4, D-6450 Hanau.

Like iron, titanium and alloys thereof can furthermore be borided; however, there must be a protective gas atmosphere or a vacuum. The Vickers hardness of the boride layer is about $3100_{0.5\ g/sq.mm.}$ In order to achieve a layer thickness of 0.03 mm, a treatment time of six hours at 1200° C. is necessary. At 900° C., a layer thickness of about 0.008 mm is achieved in the same length of time.

The foregoing methods require relatively high treatment temperatures. When the parts are cooled, difficulties occur owing to distortion. In addition, undesired and irreversible structural changes occur with these methods.

The known ionitriding method is carried out at treatment temperatures of from 400° C. to 600° C. With the aid of an abnormal glow discharge, nitrogen is produced in ionized form and embedded in the surface of the workpiece. The Vickers hardness at the surface is about $1500_{0.1\ g/sq.mm.}$ and drops to $400_{0.1\ g/sq.mm.}$ down to a depth of 30 microns.

U.K. Pat. No. 1,573,891 describes a method of imparting a nitrogen-containing surface layer to a hard metal body after sintering. The nitrogen is pressed into the voids in the hard metal lattice immediately after sintering, which leads to a distortion of the hard metal matrix and to improvement of the cutting properties. However, a measurable increase in hardness is not achieved thereby.

The purpose of all the prior art methods is to obtain better wear properties for titanium or alloys thereof. With its low specific gravity, this material achieves mechanical properties corresponding to those of hardened steel. Unfortunately, however, the inherent hardness of the material is slight, so that by means of the methods described it is attempted to attain greater hardness, and thus better wear properties, at least at the surface. Drawbacks of these methods are distortion and cracking phenomena, high costs, and undesired structural changes.

In the journal *Zeitschrift für Physik* 210, pages 70–79 (1968), the diffusion of nitrogen in metallic niobium is described. Here thin niobium wires heated by AC nd DC were exposed to a nitrogen pressure of 2 and 200 atm, respectively. The wire thus serves as resistance heating and thereby exhibits an electric field applied round the wire. The gas molecules are thereby ionized and penetrate into the wire. Here, therefore, the part to be nitrided is current-conducting, which is a drawback.

It is an object of this invention to provide a nitriding method which economically eliminates the drawback of the prior art methods described above.

A further object of this invention is to provide a nitriding method wherein no distortion of the component and no unequal tensions on the surface layer are produced.

Still another object of this invention is to provide such a method wherein the part to be nitrided does not conduct any electric current.

To this end, in the method according to the present invention, of the type initially mentioned, the chemically untreated component is exposed in an autoclave having an atmosphere consisting of nitrogen gas or gaseous nitrogen compounds to an isostatic pressure of at least 100 bar and a temperature of at least 200° C. for at least one hour, whereafter the pressure and the heat in the autoclave are steadily slowly reduced.

A continuous, uniformly distributed nitride layer approximately 20 microns thick is preferably formed on the component.

Figure 2:
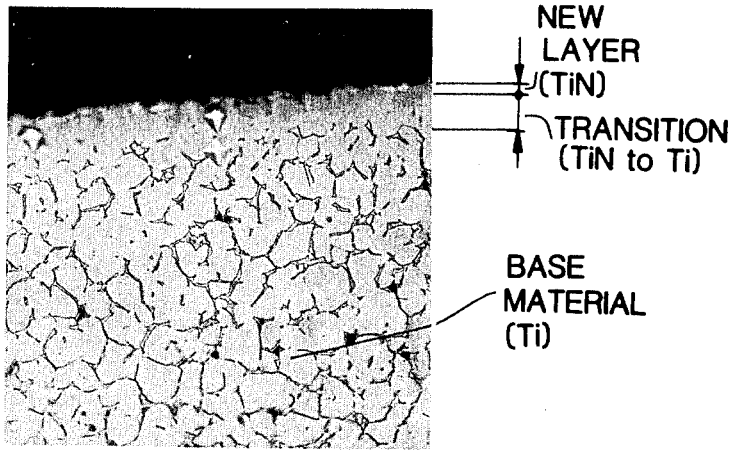

Preferred embodiments of the invention will now be described in detail with reference to the accompanying drawing, in which:

FIG. 1 is an enlarged photograph of a polished section taken form a titanium component treated in accordance with a first embodiment of the invented method, and FIG. 2 is an analogous photograph illustrating a second embodiment.

A component made, for example, of chemically non-treated titanium or alloys thereof is placed in an autoclave into which pure nitrogen gas is pumped. Instead of titanium, the other elements of the fourth, fifth, or sixth subgroups of the periodic table or alloys thereof may also be used. The atmosphere in the autoclave may be of gaseous nitrogen compounds, such as ammonia ($NH_3$) or laughing gas ($N_2O$), instead of pure nitrogen gas.

Through the combination of the pressure prevailing in the autoclave and the heat existing there, a TiN layer of about 20 microns is produced in the surface- and subsurface-zone of the titanium component. In order to form such a layer, the titanium component must be exposed to an isostatic pressure of at least 100 bar and a temperature of at least 200° C. for at least an hour. By means of the isostatic pressure in the autoclave, a continuous, uniform distribution of the nitrogen in the surface of the titanium component at every geometrical location is ensured. During cooling, the pressure and the heat drop with steady and uniform slowness. Thus, no distortion of the component and no unequal tensions in the surface layer occur.

Since the surface reaction of titanium takes place according to a parabolic rate law, the nitriding rate decreases as the nitriding time increases. The rate of diffusion of nitrogen in the outer layer of titanium nitride is therefore less than in the titanium mixed-crystal zone situated thereunder. Thus, according to nature, no thick nitride layers can form. The nitrogen or ammonia used must be very pure since oxygen would prevent the formation of a nitride layer.

The most important parameters, such as pressure, temperature, and time, are precisely measurable and adjustable. The autoclave is known in the art by the name of "hot isostatic press" and is used for this treatment with a few modifications of the gas feed and exhaust.

One or more additional hardening layers may be applied by chemical or physical vapor-phase deposit to the titanium nitride layer produced in the surface- and subsurface-zone of the titanium component by the foregoing method. Without the titanium nitride layer first formed in the surface- and subsurface-zone of the titanium component, this would not be possible because the hardening layers applied to a titanium component whose surface has not been treated as described above would be subject to peel abrasion.

According to the method described above, the nitrogen combines with the titanium to form a TiN layer in the surface- and subsurface-zone of the titanium component, this layer having a thickness of approximately 20 microns. It is possible to maintain the isostatic pressure at up to 5000 bar and the temperature at up to 1200° C. during the pause phase of the nitrogen diffusion into the titanium component. The higher these values are, the thicker, within limits, the nitride layer becomes. No application of material to the component is involved; the hardening layer grows inwardly into the component.

In order to elucidate the steps of the method described above, examples of two preferred embodiments shall be set forth:

EXAMPLE 1

A component made of the alloy Ti6 A14 V was exposed for three hours to a pressure of 900 bar nitrogen and a temperature of 1000° C. The surface had a Vickers hardness of $800_{0.50\ g/sq.mm.}$ with a layer thickness of 20 microns (see FIG. 1).

EXAMPLE 2

A component made of the alloy Ti6 A14 V was exposed for three hours to a pressure of 1300 bar nitrogen and a temperature of 930° C. The surface had a Vickers hardness of $800_{0.05\ g/sq.mm.}$ with a layer thickness of 0.012 mm (see FIG. 2).

What is claimed is:

1. A method of forming a nitride layer in the surface- and subsurface-zone of a component made of elements selected from the group consisting of Ti, Zr, Hf, Si, V, Nb, Ta, Cr, Mo, W and alloys thereof, comprising the steps of exposing the chemically untreated component in an autoclave with an atmosphere of nitrogen gas to an isostatic pressure of at least 100 bar and a temperature of at least 200° C. for at least one hour, and thereafter slowly reducing the pressure and the heat in the autoclave steadily.

2. The method of claim 1, wherein a continuous, uniformly distributed nitride layer about 20 microns thick is formed on the component.

3. The method of claim 1, comprising the further step of applying at least one further hardening layer upon said nitride layer by a deposit selected from the group consisting of chemical and physical vapor-phase deposit.

* * * * *